US009997275B2

(12) United States Patent
Huber et al.

(10) Patent No.: US 9,997,275 B2
(45) Date of Patent: Jun. 12, 2018

(54) ELECTRICAL CABLE WITH A DRAIN WIRE

(71) Applicant: MD ELEKTRONIK GmbH, Waldkraiburg (DE)

(72) Inventors: Martin Huber, Obing (DE); Michael Feist, Schwabach (DE)

(73) Assignee: MD ELEKTRONIK GmbH, Waldkraiburg (DE)

( * ) Notice: Subject to any disclaimer, the term of this patent is extended or adjusted under 35 U.S.C. 154(b) by 0 days. days.

(21) Appl. No.: 15/259,082

(22) Filed: Sep. 8, 2016

(65) Prior Publication Data

US 2017/0076836 A1 Mar. 16, 2017

(30) Foreign Application Priority Data

Sep. 11, 2015 (EP) ..... 15184894

(51) Int. Cl.

| | |
|---|---|
| ***H01B 11/04*** | (2006.01) |
| ***H01B 7/00*** | (2006.01) |
| ***H01B 11/20*** | (2006.01) |
| ***H01B 1/02*** | (2006.01) |
| ***H01B 13/00*** | (2006.01) |

(52) U.S. Cl.

CPC ..... *H01B 7/0009* (2013.01); *H01B 1/023* (2013.01); *H01B 1/026* (2013.01); *H01B 11/20* (2013.01); *H01B 13/0036* (2013.01)

(58) Field of Classification Search

CPC ..... H01B 11/04; H01B 11/06

USPC ..... 174/36, 113 R

See application file for complete search history.

(56) References Cited

U.S. PATENT DOCUMENTS

| | | | | |
|---|---|---|---|---|
| 4,477,693 | A * | 10/1984 | Krabec | H01B 11/10 174/105 R |
| 6,246,006 | B1 * | 6/2001 | Hardin | H01B 11/1091 174/106 R |
| 2003/0150633 | A1 * | 8/2003 | Hirakawa | H01B 11/002 174/36 |
| 2006/0254805 | A1 * | 11/2006 | Scherer | H01B 11/203 174/129 R |
| 2010/0084179 | A1 | 4/2010 | Harris et al. | |
| 2014/0332250 | A1 | 11/2014 | Diaz Ortega et al. | |

FOREIGN PATENT DOCUMENTS

WO WO 2013060402 A1 5/2013

* cited by examiner

*Primary Examiner* — Chau N Nguyen

(74) *Attorney, Agent, or Firm* — Leydig, Voit & Mayer, Ltd.

(57) ABSTRACT

An electrical cable includes a cable jacket surrounding a cable interior. At least one electrical cable conductor is disposed in the cable interior and has an insulating sheath. A cable shield shields the cable interior. At least one electrically conductive drain wire associated with the cable shield is disposed in the cable interior in electrical contact with the cable shield. The at least one drain wire includes a ferromagnetic material.

16 Claims, 3 Drawing Sheets

ELECTRICAL CABLE WITH A DRAIN WIRE

CROSS-REFERENCE TO PRIOR APPLICATION

Priority is claimed to European Patent Application No. EP 15 184 894.2, filed on Sep. 11, 2015, the entire disclosure of which is hereby incorporated by reference herein.

FIELD

The present invention relates to an electrical cable having a drain wire.

BACKGROUND

Such a cable includes a jacket (cable jacket) surrounding a cable interior, as well as at least one electrical cable conductor disposed in the cable interior, surrounded by an insulating sheath and extending within the interior of the cable along the longitudinal direction thereof, the cable including in particular at least two such conductors. Further provided is a shield (cable shield) for shielding the interior of the cable, the shield being associated with at least one drain wire disposed in the interior of the cable. Like the conductors(s) of the cable, the drain wire is formed of electrically conductive material, but is not surrounded by an insulating sheath so that it can come into electrical contact with the cable shield. It is a function of the drain wire to bring the cable shield to ground potential, and to do so even when the shield is damaged, such as when a shield in the form of a film is torn in some sections. Moreover, a respective drain wire may itself contribute to the shielding of the interior of the cable (shielding effect of a drain wire). For this purpose, the drain wire extends, for example, within the interior of the cable along the conductor(s) disposed therein, from a first end to the other end of the cable.

This is a common, generally known cable design, such as is described, for example, in International Patent Application Publication No. WO 2013/060402 A1.

When assembling such a cable, for example, to provide the cable with an electrical connector, a respective drain wire must be separated from the conductor(s) of the cable. This requires quite some assembly effort, especially because the conductor(s) and drain wire(s) are only accessible through the cable jacket and the cable shield, which must be opened for this purpose.

SUMMARY

In an embodiment, the present invention provides an electrical cable including a cable jacket surrounding a cable interior. At least one electrical cable conductor is disposed in the cable interior and has an insulating sheath. A cable shield shields the cable interior. At least one electrically conductive drain wire associated with the cable shield is disposed in the cable interior in electrical contact with the cable shield. The at least one drain wire includes a ferromagnetic material.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 2:
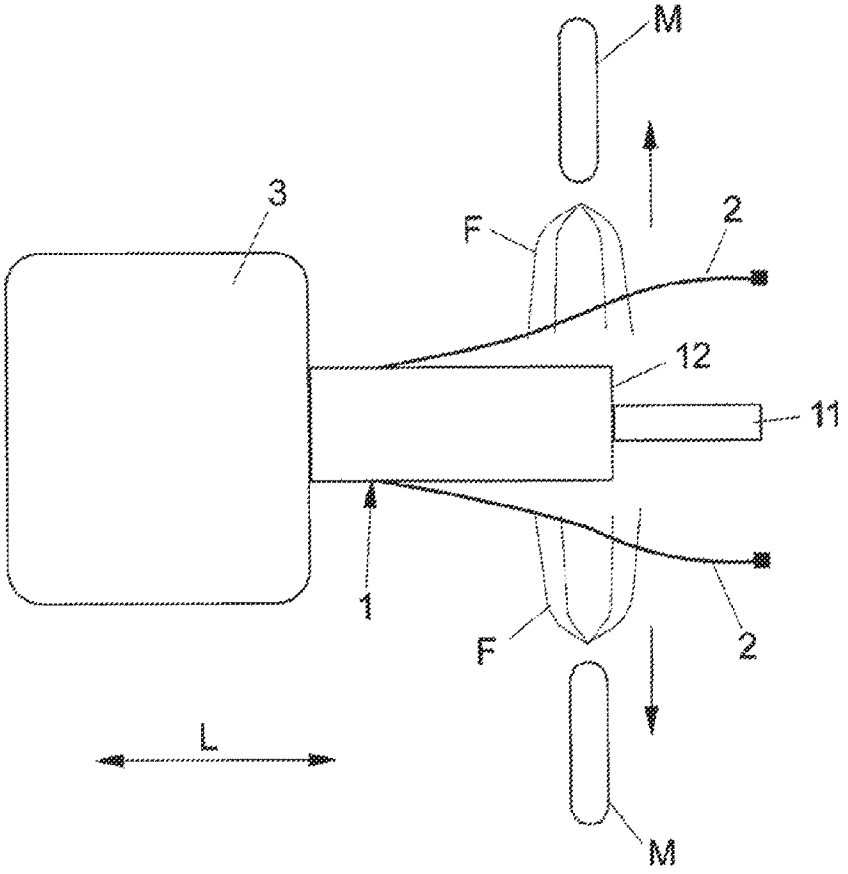
FIG. 2 is a side view showing the electrical cable of FIG. 1 during the assembly thereof.

In an embodiment, the present invention provides an electrical cable of the above mentioned type that has a drain wire and that simplifies the assembly of cable assemblies.

According to an embodiment, at least one drain wire of the cable includes a ferromagnetic material. Because a respective drain wire is at least partially made of ferromagnetic material, it can be easily separated from the conductors of a cable by exposing the cable assembly to a magnetic field that selectively moves the drain wire(s) (composed of a ferromagnetic material) along a guide path. In this way, a respective drain wire can be moved to a position that enables or facilitates the further processing/assembly of the cable.

The ferromagnetic material may be an alloy, in particular steel, for example based on iron, nickel and/or cobalt.

In a first embodiment of the present invention, the drain wire is completely made of an electrically conductive ferromagnetic material, such as, for example steel. In another embodiment, the drain wire includes at least one core made of a ferromagnetic material and surrounded by an electrically conductive material. This embodiment of the invention makes it possible, on the one hand, to optimize the core of a respective drain wire with respect to the ferromagnetic properties and, other hand and independently thereof, to optimize the electrically conductive material surrounding the core with respect to the electrical conduction properties. Copper, for example, is a suitable electrically conductive material that may be applied as a coating to the core, in particular by electrodeposition.

A respective conductor and/or a respective drain wire of the electrical cable may in particular be a stranded drain wire composed of a plurality of strands. In the case of a drain wire having at least one core made of a ferromagnetic material and surrounded by an electrically conductive material, this means that a respective strand has a core of a ferromagnetic material as well as a layer of an electrically conductive material surrounding the core.

To enable easy separation of the drain wire(s) from the other components of the cable, such as the cable shield and the conductors, non-ferromagnetic materials are advantageously for these components, in particular for the cable shield. Aluminum, for example, is a suitable material for the cable shield.

The cable shield may be formed on the one hand by a braid, or on the other hand by a film. The latter may, for example, be composed of aluminum or take the form of a plastic film that is coated with an electrically conductive material, such as aluminum, on its inner surface facing the interior of the cable.

A cable shield in the form of a film may be placed around the interior of the cable in such a way that the end portions of the cable shield or film overlap each other in the circumferential direction. Under the action of magnetic forces used to separate the drain wire(s) from the conductors of the cable, this overlap may be removed automatically when the drain wire(s) urge outwardly and act on the cable shield.

The cable shield is disposed between the jacket and the interior of the cable in a manner that enables electrical contact between the cable shield and a drain wire disposed in the cable interior. The cable shield may be incorporated in the cable jacket, for example, by adhesively bonding the outer surface of the cable shield, which faces away from the interior of the cable, to the cable jacket.

According to another embodiment, a method for manufacturing an electrical cable having a drain wire is provided.

Other details and advantages of the present invention will become apparent from the following description of an exemplary embodiment, taken in conjunction with the figures.

Figure 1:
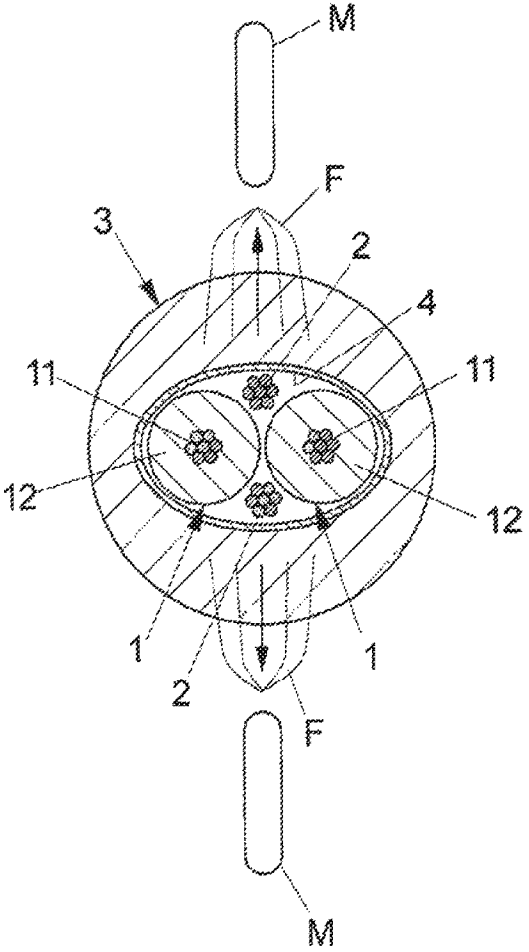
FIG. 1 is a cross section through an electrical cable having a drain wire.

FIG. 1 shows an electrical cable, which in the exemplary embodiment takes the form of a two-conductor cable. The two conductors 1 of the cable extend side-by-side along longitudinal direction L of the cable (see FIG. 2). They are each composed of an electrical lead 11, for example of copper, as well as an insulating sheath 12 surrounding the respective lead.

The conductors 1 of the cable are arranged together within a cable interior which is defined by a cable jacket 3 and annularly surrounded by it, as viewed in cross section. Cable jacket 3 is composed of an electrically insulating material.

Furthermore, a cable shield 4 is disposed between cable jacket 3 and the cable interior, which serves to accommodate conductors 1. Cable shield 4 may be formed by a braided shield or by a film. The cable shield is used for shielding the interior of the cable and is made of a metallic material, such as, for example, aluminum for this purpose. Thus, for example, a cable shield 4 in the form of a film may be an aluminum foil. Alternatively, it is possible to use for this purpose a plastic film that is coated with an electrically conductive material, such as aluminum, on its inner surface facing the interior of the cable.

Braided shields are used, in particular, for shielding in the case of relatively low frequencies, while cable shields in the form of films are used for shielding in the case of relatively high frequencies (1 MHz to 10 GHz).

Figure 3:
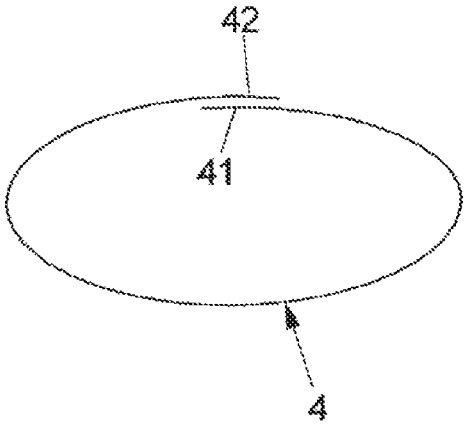
FIG. 3 is a schematic cross section through a shield for the cable of FIGS. 1 and 2.

FIG. 3 schematically shows a possible specific embodiment of a cable shield 4. Here, cable shield 4 takes the form of a film and is placed around the interior of the cable in such a way that the two end portions 41, 42 of the film overlap each other in the circumferential direction. When the interior of the cable has to be accessed (for example, during assembly of the cable), cable shield 4 can be selectively opened in the resulting overlap region.

Cable shield 4 and cable jacket 3 may be combined into one unit, for example by bonding the outer surface of cable shield 4, which faces away from the interior of the cable, to cable jacket 3, for example by an adhesive.

In the present embodiment, in addition to conductors 1, drain wires 2 are disposed in the cable interior, each extending, together with conductors 1, along longitudinal direction L of the cable. Drain wires 2 are electrically conductive and not insulated and are in electrical contact with cable shield 4. Such drain wires 2 are used to bring cable shield 4 to ground potential in a defined manner, and advantageously to do so even when cable shield 4 is locally damaged, such as when a cable shield 4 in the form of a film is torn in some sections. Moreover, drain wires 2 may, in addition, contribute to the shielding of the cable interior.

For purposes of assembling a cable of the type shown in FIG. 1, for example, to provide the cable with an electrical connector, drain wires 2 must be separated from conductors 1 to enable a respective cable component to be moved to the connector region intended for this purpose. In the present case, to facilitate such assembly work, a respective drain wire 2 includes a magnetic, in particular ferromagnetic material. This material may be an alloy (based on iron, nickel, cobalt), in particular steel.

In a variant, a respective drain wire 2 is completely made of an electrically conductive ferromagnetic material. In another variant, a respective drain wire 2 includes at least one core made of a ferromagnetic material and surrounded by an electrically conductive material. This embodiment makes it possible, on the one hand, to optimize the core of a respective drain wire 2 with respect to the magnetic properties and to optimize the conductive outer portion of a respective drain wire 2 with respect to the electrical properties (also with respect to the skin effect at high frequencies). Thus, a respective drain wire 2 may be composed, for example, of a core of steel coated with copper. The coating may be applied, for example, by electrodeposition. In a refinement, the drain wires may, in addition, be silver-plated, gold-plated or coating with platinum.

Figure 1A:
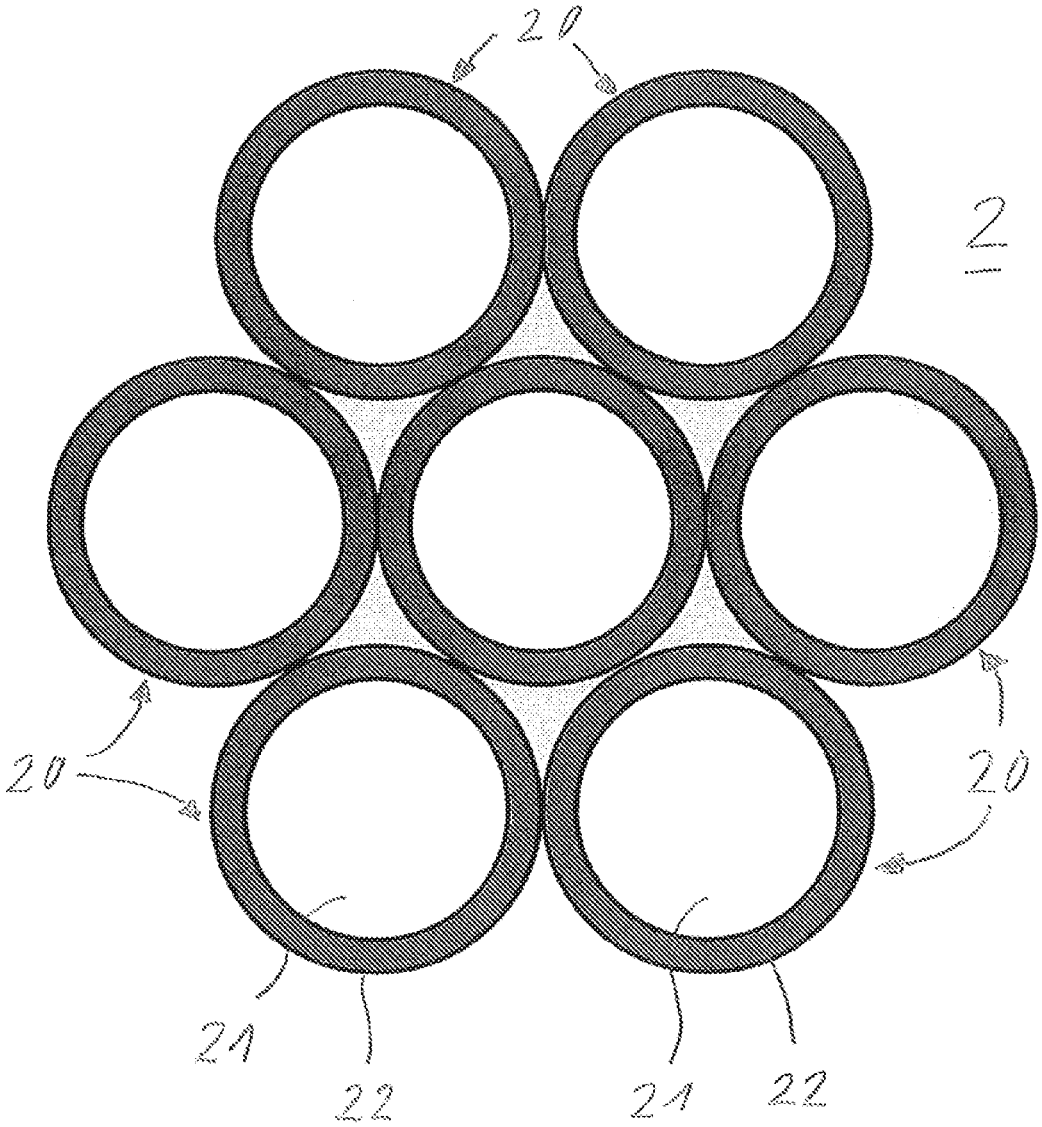
FIG. 1A is an enlarged view of the cross section of the drain wire of FIG. 1.

In the present embodiment, both a respective conductor 1 and a respective drain wire 2 of the electrical cable of FIG. 1 are composed of a plurality of strands. In the enlarged view of FIG. 1A, this is illustrated by way of example for a drain wire 2. Accordingly, drain wire 2 includes a plurality of (in the exemplary embodiment a total of seven) strands 20. One of these is disposed centrally and surrounded by the other (six) ones. A respective strand 20 of drain wire 2 has a ferromagnetic core 21 of, for example, steel, iron, nickel or cobalt, as well as an electrically conductive coating 22 of, for example, copper. This coating may be applied by electrodeposition and may, for example, be platinum-plated. The electrically conductive material surrounding core 21 may have a layer thickness of from 3 μm to 300 μm, in particular of up to 100 μm.

For purposes of assembling the cable of FIG. 1, for example, to provide the cable with an electrical connector, cable jacket 3 is removed from an end portion of the cable, as illustrated in FIG. 2. If cable shield 4 of the respective cable is bonded to cable jacket 3, for example held thereto by an adhesive, then cable shield 4 is removed simultaneously with the cable jacket 3 during removal thereof. This corresponds to the situation shown in FIG. 2.

In contrast, if there is no bond between the cable jacket and cable shield 4, then cable shield 4 must be removed separately during assembly of the cable, or cable shield 4 opens automatically when drain wires 2 are separated from conductors 1 of the cable. In the case of a cable shield 4 of the type shown in FIG. 3, this is easily possible, as will be discussed in more detail below.

In the present embodiment, magnetic forces are used to separate drain wires 2 from conductors 1 of the cable, for example to enable those cable components 1, 2 to be moved to the corresponding connection regions of a connector. For this purpose, as can be seen from FIGS. 1 and 2, a magnet M is approached to a respective drain wire 2 at a cable end after cable jacket 3 has been cut open at the respective cable end. Magnet M produces a magnetic field F which, because of the ferromagnetic material included in the drain wire, tends to move the respective drain wire 2 out of the interior of the cable, as is apparent from the transition from FIG. 1 to FIG. 2. In this way, drain wires 2 can be easily separated from conductors 1 of the cable without having to manipulate conductors 1 and/or drain wires 2 with tools.

What is essential to the method according to an embodiment described herein is that a respective drain wire 2 include a material having such magnetic properties that drain wire 2 can be separated from conductors 1 of a cable under the action of magnetic forces. This means that the magnetic properties of drain wire 2 must differ from those of a respective conductor 1.

By lifting a respective drain wire 2 out of the interior of the cable under the action of magnetic forces, as illustrated in FIG. 2, it is possible to automatically open a cable shield 4 formed by a film of the type shown in FIG. 3. This merely requires that the ends 41, 42 of cable shield 4 move away from one another under the action of the outwardly moving drain wires 2.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE NUMERALS

1 conductor
11 lead
12 insulating sheath
2 drain wire
20 strand
21 core
22 coating
3 cable jacket
4 cable shield
41 first end
42 second end
F magnetic field
L longitudinal direction of the cable
M magnet

What is claimed is:

1. A method for manufacturing an electrical cable having a cable jacket surrounding a cable interior in which is disposed at least one electrical conductor provided with an insulating sheath and at least one electrically conductive drain wire, each extending along a longitudinal direction of the cable, the drain wire being in electrical contact with a shield of the cable, the method comprising:

using, for the at least one drain wire, a ferromagnetic material that has magnetic properties which differ from those of the material of the at least one conductor in such a way that the drain wire experiences a greater deflection than the conductor in a given magnetic field; and assembling the electrical cable including:

separating the at least one drain wire from the at least one conductor by exposing the cable to a magnetic field.

2. The method as recited in claim 1, wherein the at least one conductor and the at least one drain wire extend side-by-side in the cable interior along a longitudinal direction of the cable between two ends thereof.

3. The method as recited in claim 1, wherein the at least one conductor includes at least two conductors each disposed in the cable interior.

4. The method as recited in claim 1, wherein the ferromagnetic material is an alloy.

5. The method as recited in claim 4, wherein the alloy is steel.

6. The method as recited in claim 1, wherein the at least one drain wire is completely made of an electrically conductive ferromagnetic material.

7. The method as recited in claim 1, wherein the at least one drain wire includes at least one core made of the ferromagnetic material and surrounded by an electrically conductive material.

8. The method as recited in claim 7, wherein the electrically conductive material is copper.

9. The method as recited in claim 7, wherein the at least one core of the at least one drain wire is coated by electrodeposition.

10. The method as recited in claim 7, wherein the at least one core of the at least one drain wire is coated with the electrically conductive material.

11. The method as recited in claim 7, wherein the at least one drain wire includes a stranded drain wire composed of a plurality of strands, each of the strands having a ferromagnetic core and an electrically conductive coating applied thereto.

12. The method as recited in claim 1, wherein the cable shield is composed of a non-ferromagnetic material.

13. The method as recited in claim 1, wherein the cable shield includes aluminum.

14. The method as recited in claim 1, wherein the cable shield is formed by a braided shield or by a film.

15. The method as recited in claim 14, wherein the cable shield in the form of the film is placed around the interior of the cable, with two ends of the cable shield overlapping each other in the circumferential direction of the cable without being firmly joined together.

16. The method as recited in claim 1, wherein the cable shield is firmly bonded to the cable jacket.

* * * * *